US009437211B1

(12) United States Patent
Su

(10) Patent No.: US 9,437,211 B1
(45) Date of Patent: Sep. 6, 2016

(54) ADAPTIVE DELAY FOR ENHANCED SPEECH PROCESSING

(71) Applicant: Huan-Yu Su, Irvine, CA (US)

(72) Inventor: Huan-Yu Su, Irvine, CA (US)

(73) Assignee: QOSOUND, INC., Irvine, CA (US)

( * ) Notice: Subject to any disclaimer, the term of this patent is extended or adjusted under 35 U.S.C. 154(b) by 0 days.

(21) Appl. No.: 14/534,531

(22) Filed: Nov. 6, 2014

Related U.S. Application Data

(63) Continuation-in-part of application No. 14/193,606, filed on Feb. 28, 2014.

(60) Provisional application No. 61/905,674, filed on Nov. 18, 2013.

(51) Int. Cl.
*G10L 21/0208* (2013.01)

(52) U.S. Cl.
CPC ..... *G10L 21/0208* (2013.01)

(58) Field of Classification Search
CPC ..... G10L 21/0208; G10L 19/005
See application file for complete search history.

(56) References Cited

U.S. PATENT DOCUMENTS 8,024,192 B2 * 9/2011 Zopf ..... G10L 19/005 341/143
2003/0069018 A1 * 4/2003 Matta ..... H04L 41/5009 455/436
2004/0010407 A1 * 1/2004 Kovesi ..... G10L 19/005 704/219
2006/0100867 A1 * 5/2006 Lee ..... G10L 21/0208 704/226
2006/0265216 A1 * 11/2006 Chen ..... G10L 19/005 704/228
2006/0271373 A1 * 11/2006 Khalil ..... G10L 21/045 704/500
2008/0133242 A1 * 6/2008 Sung ..... G10L 19/005 704/262
2008/0243495 A1 * 10/2008 Anandakumar ..... G10L 19/005 704/214
2009/0070107 A1 * 3/2009 Kawashima ..... G10L 19/002 704/229
2009/0276212 A1 * 11/2009 Khalil ..... G10L 21/045 704/226
2011/0125505 A1 * 5/2011 Vaillancourt ..... G10L 19/005 704/500
2011/0196673 A1 * 8/2011 Sharma ..... G10L 19/005 704/207
2012/0123775 A1 * 5/2012 Murgia ..... G10L 21/0364 704/228
2013/0166294 A1 * 6/2013 Cox ..... G10L 15/02 704/238
2014/0235192 A1 * 8/2014 Purnhagen ..... G10L 19/008 455/296

* cited by examiner

*Primary Examiner* — Douglas Godbold
(74) *Attorney, Agent, or Firm* — Keith Kind

(57) ABSTRACT

Provided is a system, method, and computer program product for improving the quality of voice communications on a mobile handset device by dynamically and adaptively selecting adjusting the latency of a voice call to accommodate an optimal speech enhancement technique in accordance with the current ambient noise level. The system, method and computer program product improves the quality of a voice call transmitted over a wireless link to a communication device dynamically increasing the latency of the voice call when the ambient noise level is above a predetermined threshold in order to use a more robust high-latency voice enhancement technique and by dynamically decreasing the latency of the voice call when the ambient noise level is below a predetermined threshold to use the low-latency voice enhancement techniques. The latency periods are adjusted by adding or deleting voice samples during periods of unvoiced activity.

24 Claims, 11 Drawing Sheets

ADAPTIVE DELAY FOR ENHANCED SPEECH PROCESSING

CROSS REFERENCE TO OTHER APPLICATIONS

The present application is related to co-pending U.S. patent application Ser. No. 13/975,344 entitled "METHOD FOR ADAPTIVE AUDIO SIGNAL SHAPING FOR IMPROVED PLAYBACK IN A NOISY ENVIRONMENT" filed on Aug. 25, 2013 by HUAN-YU SU, et al., co-pending U.S. patent application Ser. No. 14/193,606 entitled "IMPROVED ERROR CONCEALMENT FOR SPEECH CODER" filed on Feb. 28, 2014 by HUAN-YU SU, and co-pending U.S co-pending patent application Ser. No. 14/534,472 entitled "ADAPTIVE SIDETONE TO ENHANCE TELEPHONIC COMMUNICATIONS" filed concurrently herewith by HUAN-YU SU. The above referenced pending patent applications are incorporated herein by reference for all purposes, as if set forth in full.

SUMMARY OF THE INVENTION

The improved quality of voice communications over mobile telephone networks have contributed significantly to the growth of the wireless industry over the past two decades. Due to the mobile nature of the service, a user's quality of experience (QoE) can vary dramatically depending on many factors. Two such key factors include the wireless link quality and the background or ambient noise levels. It should be appreciated, that these factors are generally not within the user's control. In order to improve the user's QoE, the wireless industry continues to search for quality improvement solutions to address these key QoE factors.

In theory, ambient noise is always present in our daily lives and depending on the actual level, such noise can severely impact our voice communications over wireless networks. A high noise level reduces the signal to noise ratio (SNR) of a talker's speech. Studies from members of speech standard organizations, such as 3GPP and ITU-T, show that lower SNR speech results in lower speech coding performance ratings, or low MOS (mean opinion score). This has been found to be true for all LPC (linear predictive coding) based speech coding standards that are used in wireless industry today.

Another problem with high level ambient noise is that it prevents the proper operation of certain bandwidth saving techniques, such as voice activity detection (VAD) and discontinuous transmission (DTX). These techniques operate by detecting periods of "silence" or background noise. The failure of such techniques due to high background noise levels result in the unnecessary bandwidth consumption and waste.

Since the standardization of EVRC (enhanced variable rate codec, IS-127) in 1997, the wireless industry had embraced speech enhancement techniques that operate to cancel or reduce background noise. Of course, such speech enhancement techniques require processing time, which is always at odds with the requirement for low latency in voice communications. Due to the interactive nature of live voice conversations, mobile telephone calls require extremely low end-to-end (or mouth-to-ear) delays or latency. Indeed ITU-T Recommendations call for such latency to be less than 300 ms, otherwise users start to be dissatisfied by the voice quality (c.f., Recommendation G.114). Since 2G/3G systems all have relatively long end-to-end latencies compared to ITU-T Recommendations, it is therefore an industry standard approach to limit the allowed latency increase of such speech enhancement techniques to some very small number, such as 5 to 10 ms. As can be appreciated, this may severely limit the effectiveness of such speech enhancement techniques.

Unfortunately, modern speech processing techniques inevitably require to perform a certain level of signal analyses, which rely on the availability of the input signal for a fixed amount of time. When the latency requirement is very short, a lack of sufficient observation time often results in incorrect analysis and bad decisions that translate to reduced performance. It is therefore intuitive that when more latency is allowed, better performance is possible. It is noted that low latency implementations of signal detection techniques can perform adequately under low noise conditions, but it becomes increasingly difficult under high noise level conditions.

In general, newer wireless access technologies such as LTE (Long-Term Evolution) have lower end-to-end latency periods than previous generations, such as GSM or W-CDMA. The present invention takes advantage of this factor to further improve speech enhancement techniques while still maintaining the overall latency requirements under ITU-T Recommendations.

The present invention addresses the need for increased quality by providing an adaptive system that, based on the ambient noise level, dynamically adjusts the latency allocation to achieve a higher level of performance in preprocessing across all application scenarios.

More particularly, the present invention provides an adaptive latency system and method that in low noise conditions, provides the same or shorter latency allocation time for the speech enhancement module, but while in high noise conditions, provides a larger latency increase allotment to the speech enhancement module for increased performance.

DETAILED DESCRIPTION

The present invention may be described herein in terms of functional block components and various processing steps. It should be appreciated that such functional blocks may be realized by any number of hardware components or software elements configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data and voice transmission protocols, and that the system described herein is merely one exemplary application for the invention.

It should be appreciated that the particular implementations shown and described herein are illustrative of the invention and its best mode and are not intended to otherwise limit the scope of the present invention in any way. Indeed, for the sake of brevity, conventional techniques for signal processing, data transmission, signaling, packet-based transmission, network control, and other functional aspects of the systems (and components of the individual operating components of the systems) may not be described in detail herein, but are readily known by skilled practitioners in the relevant arts. Furthermore, the connecting lines shown in the various figures contained herein are intended to represent exemplary functional relationships and/or physical couplings between the various elements. It should be noted that many alternative or additional functional relationships or physical connections may be present in a practical communication system. It should be noted that the present invention is described in terms of a typical mobile phone system. However, the present invention can be used with any type of communication device including non-mobile phone systems, laptop computers, tablets, game systems, desktop computers, personal digital infotainment devices and the like. Indeed, the present invention can be used with any system that supports digital voice communications. Therefore, the use of cellular mobile phones as example implementations should not be construed to limit the scope and breadth of the present invention.

Figure 1:
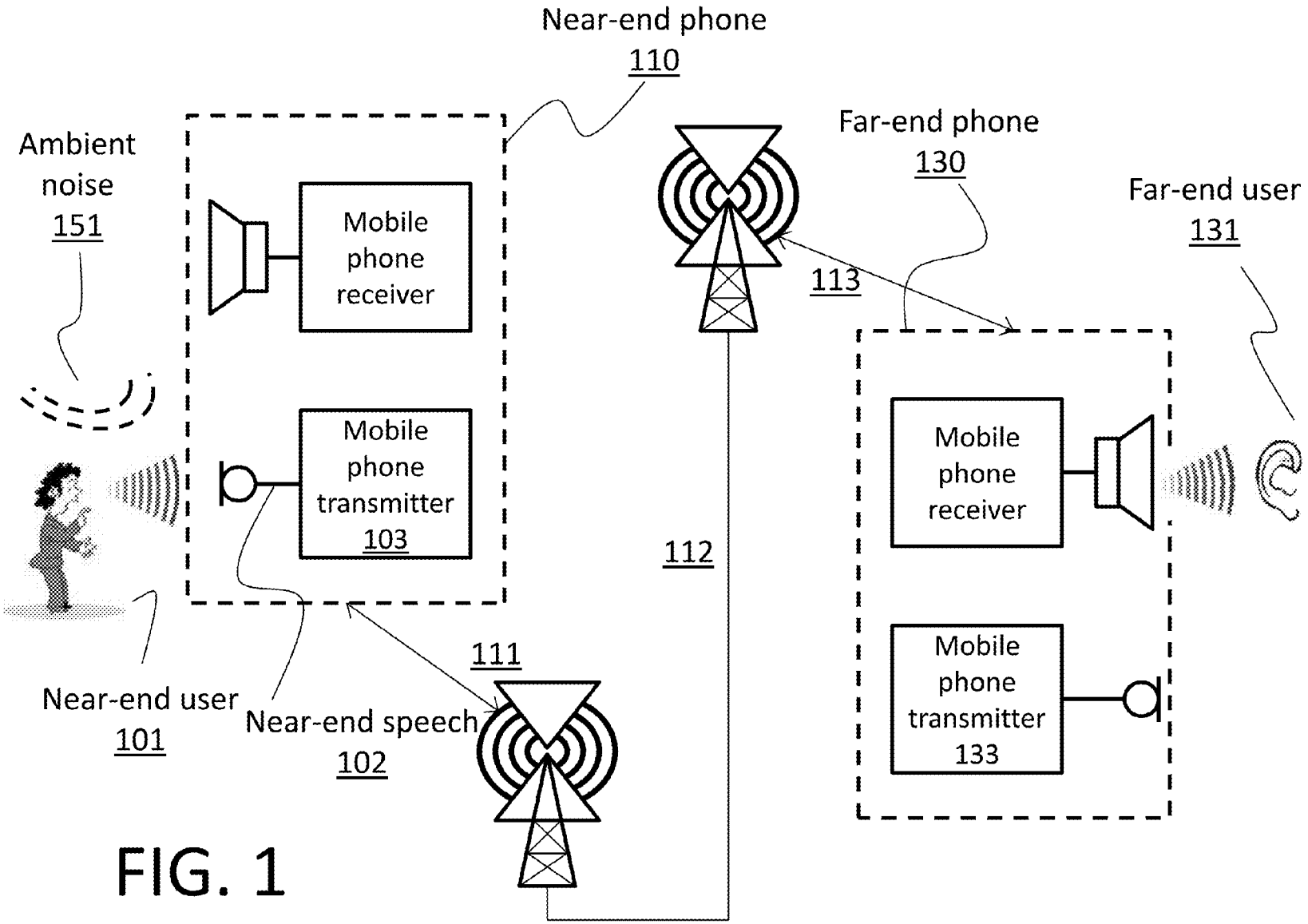
FIG. 1 is an exemplary schematic block diagram representation of a mobile phone communication system in which various aspects of the present invention may be implemented.

FIG. 1 illustrates a typical mobile phone system where two mobile phones, 110 and 130, are coupled together via certain wireless and wireline connectivity represented by the elements 111, 112 and 113. When the near-end talker 101 speaks into the microphone, the speech signal, together with the ambient noise 151, is picked up by the near-end microphone, which produces a near-end speech signal 102. The near-end speech signal 102 is received by the near-end mobile phone transmitter 103, which applies certain compression schemes before transmitting the compressed (or coded) speech signal to the far-end mobile phone 110 via the wireless/wireline connectivity, according to whatever wireless standards the mobile phones and the wireless access/transport systems support. Once received by the far-end mobile phone 130, the compressed speech is converted back to its linear form referred to as reconstructed near-end speech (or simply, near-end speech) before being played back through a loudspeaker or earphone to the far-end user 131.

Figure 2A:
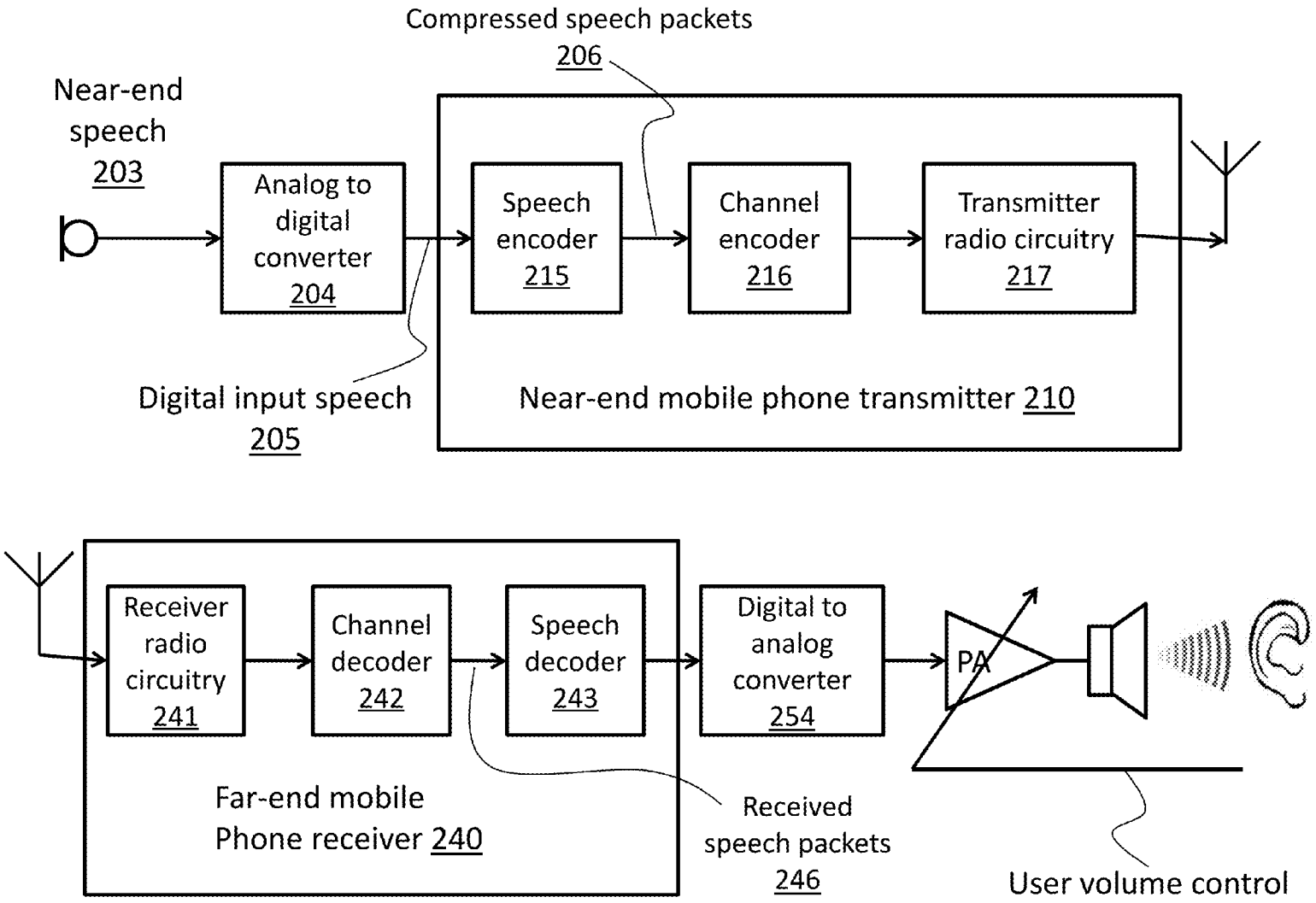
FIG. 2A is an exemplary flowchart of a speech transmitter and receiver for a mobile phone communication system.

FIG. 2A is a flow diagram that shows details the relevant processing units inside the near-end mobile phone transmitter and the far-end mobile phone receiver in accordance with one example embodiment of the present invention. The near-end speech 203 is received by an analog to digital convertor 204, which produces a digital form 205 of the near-end speech. The digital speech signal 205 is fed into the near-end mobile phone transmitter 210. A typical near-end mobile phone transmitter will now be described in accordance with one example embodiment of the present invention. First, the digital input speech 205 is compressed by the speech encoder 215 in accordance with whatever wireless speech coding standard is being implemented. Next, the compressed speech packets 206 go through a channel encoder 216 to prepare the packets 206 for radio transmission. The channel encoder is coupled with the transmitter radio circuitry 217 and is then transmitted over the near-end phone's antenna.

On the far-end phone, the reverse processing takes place. The radio signal containing the compressed speech is received by the far-end phone's antenna in the far-end mobile phone receiver 240. Next, the signal is processed by the receiver radio circuitry 241, followed by the channel decoder 242 to obtain the received compressed speech, referred to as speech packets or frames 246. Depending on the speech coding scheme used, one compressed speech packet can typically represent 5-30 ms worth of a speech signal.

Due to the never ending evolution of wireless access technology, it is worth mentioning that the combination of the channel encoder 216 and transmitter radio circuitry 217, as well as the reverse processing of the receiver radio circuitry 241 and channel decoder 242, can be seen as wireless modem (modulator-demodulator). Newer standards in use today, including LTE, WiMax and WiFi, and others, comprise wireless modems in different configurations than as described above and in FIG. 2A. The use of the example wireless modems are shown for simplicity sake and are examples of one embodiment of the present invention. As such, the use of such examples should not be construed to limit the scope and breadth of the present invention.

Figure 2B:
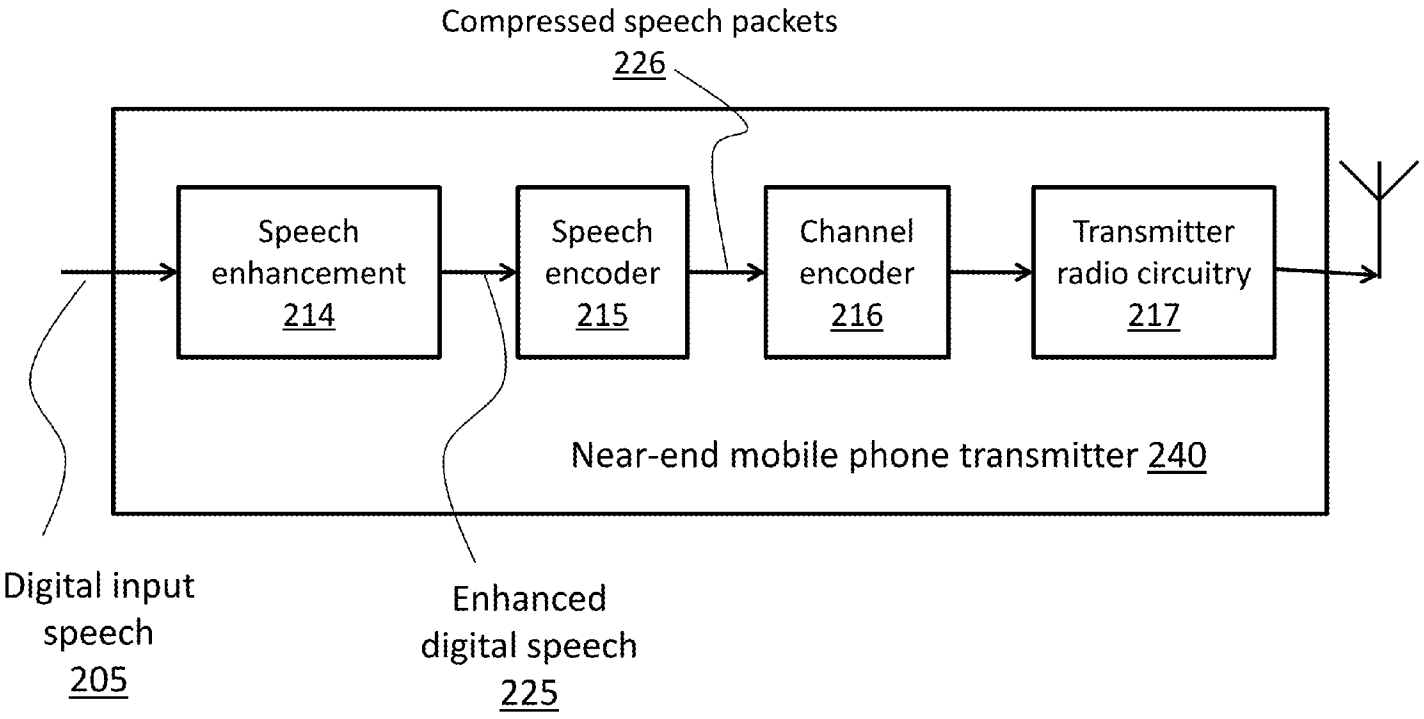
FIG. 2B illustrates the use of an exemplary speech enhancement module in a speech transmitter in accordance with one embodiment of the present invention.

FIG. 2B illustrates the use of an exemplary speech enhancement module in a speech transmitter in accordance with one embodiment of the present invention. The digital input is received by the speech enhancement module 214. This module 214 may contain any speech enhancement technique that seeks to enhance speech quality by improving the intelligibility and/or overall perceptual quality of speech signals. Enhancement of speech by cancelling or reducing perceived background noises are important examples of a such speech enhancement techniques.

Referring back now to FIG. 2B, the enhanced digital speech signal 225 is next fed into the speech encoder 215. The enhanced digital speech 225 is compressed by the speech encoder 215 in accordance with whatever wireless speech coding standard is being implemented. Next, the enhanced compressed speech packets 226 go through a channel encoder 216 to prepare the packets 226 for radio transmission. The channel encoder is coupled with the transmitter radio circuitry 217 and is then transmitted over the near-end phone's antenna.

Figure 3A:
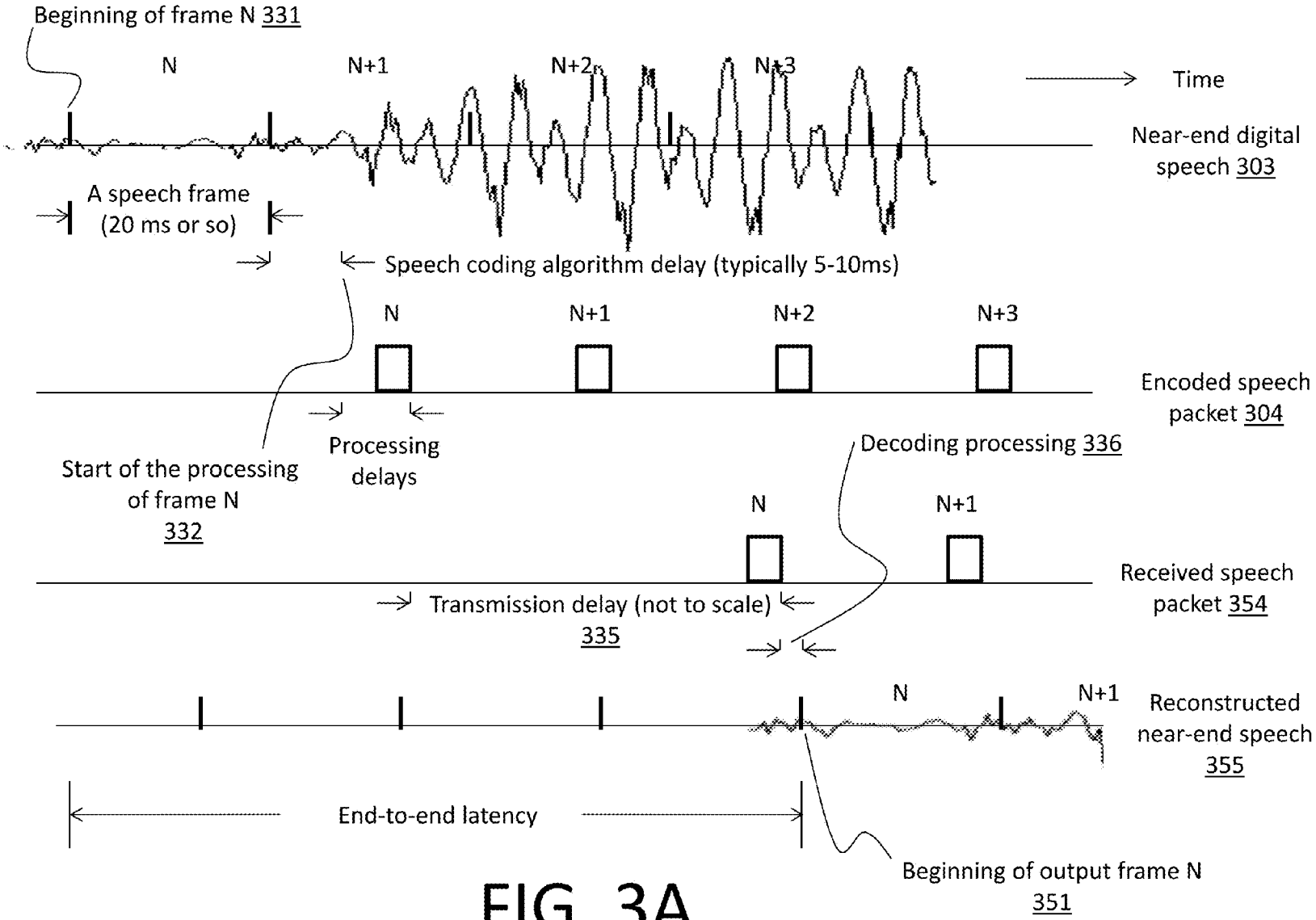
FIG. 3A illustrates a typical mouth-to-ear latency breakdown in a mobile communication system.

Now referring to FIG. 3A, where, for simplicity, it is assumed that both mobile phones are using the same speech coding standard, and as such, there is no requirement for additional format conversion steps in the intermediate connections between the sending and receiving mobile units, as described above.

At the beginning of the processing frame N (or more precisely the first speech sample in frame N) 331, the speech encoder collects a frame worth of the near-end digital speech samples 303. Depending on the speech coding standard used, this sample collection time is equal to the processing frame size in time. When the sample collection is complete for the processing frame N, the encoding of the frame N starts as shown at 332. It should be noted that modern speech compression techniques will benefit from a small, but non-zero, so-called "look-ahead latencies". Some examples of such look-ahead latencies are a 5 ms LPC (linear prediction coding) look-ahead in 3GPP AMR-NB standard and a 10 ms latency in the EVRC (Enhanced variable rate codec) standard.

The encoding process will take some time as commercial implementations of the speech encoder employ the use of either digital signal processors (DSPs), embedded circuitry or other types of processors such as general purpose programmable processors, all with finite processing capabilities. As such, any signal processing task will take a certain amount of time to be executed. This processing time will add to the latency. At the completion of the speech encoding process, the encoded speech packet 304 is ready for transmission via the wireless modem of the near-end mobile phone.

As previously stated, the encoded speech packet will go through a good number of steps before it is received at the far-end mobile phone. For simplicity, and without changing the scope of the present invention, the time it takes can be grouped together and thought of as a single time period referred to herein as the "transmission delay" 335. Once received, the speech decoder uses information contained in the received speech packet 354 to reconstruct the near-end speech 355, which will also take some non-zero processing time before the first speech sample 351 in the frame N can be sent to the loudspeaker for output. The total end-to-end latency (or mouth-to-ear delay) is the time elapsed from the moment the first sample in the frame N becomes available at the near-end mobile phone, to the time when the first corresponding sample is played out at the far-end phone.

Figure 3B:
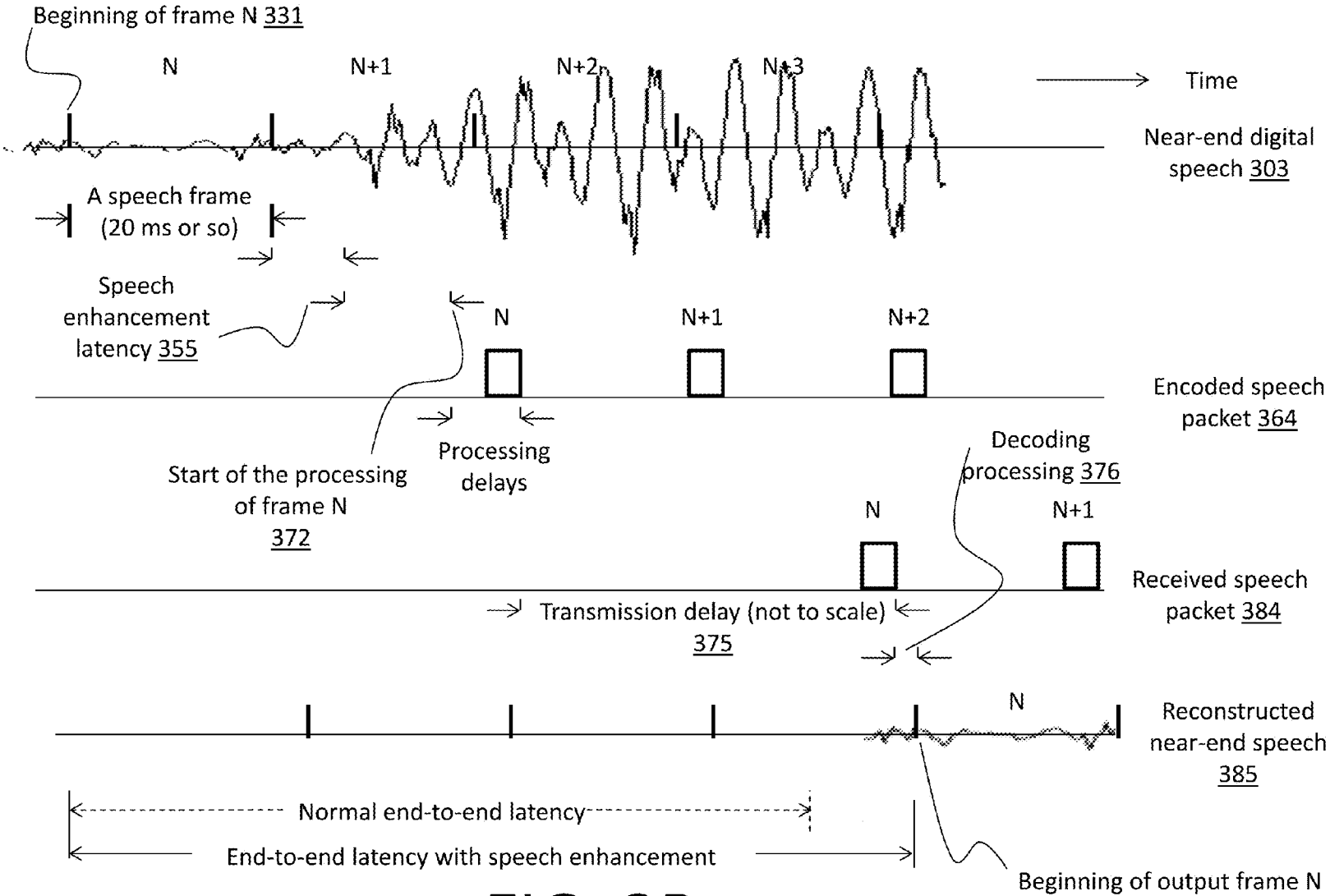
FIG. 3B illustrates the latency increase as the result of a speech enhancement technique in accordance with an example embodiment of the present invention.

FIG. 3B depicts a similar end-to-end latency break-down with the addition of a latency increase 355 at the near-end phone due to the addition of a speech enhancement technique. It is clear that this additional speech enhancement latency translates to a direct increase to the end-to-end latency as shown at the bottom on FIG. 3B, where the normal end-to-end latency is compared with the end-to-end latency with speech enhancement.

Because the end-to-end latencies in today's 2G or 3G wireless networks are all above 100 ms, it is highly desirable to not significantly increase that figure by the use of speech enhancement techniques. To that end, it is a common practice to limit the amount of processing time allocated for speech enhancement techniques. For example, the SMV and EVRC-B standards limit such techniques to approximately 10 ms or less.

Ambient noise typically comprises a time varying nature. That is, ambient noise typically comprises dramatic variations in volume and spectrum characteristics. When noise is at a low level, the amount of noise reduction (or speech enhancement) requirements are minimal. In addition, signal detection and analysis can be performed faster and much more reliably because the voice signal is cleaner to begin with. However, when the noise is at a high level, the signal to noise ratio (SNR) of the talker's speech is reduced, which causes a degradation in speech coding performance due to an increase in error of parameter detection.

Speech enhancement and indeed, speech processing in general, requires the determination of certain critical parameters of the speech on a frame by frame basis. Such critical parameters include voiced vs. un-voiced speech, the period of the fundamental frequency or pitch of the talker, the beginning and/or end of voiced speech, and the fine structure of the spectrum of the talker. These and other critical determinations can be severely impacted by an increase to noise levels and the consequential reduction of the SNR. The present invention improves the accuracy of such critical parameter determination by providing additional observation of the speech signal by adaptively increasing the latency budget for the speech enhancement module during certain periods, based on the detected ambient noise levels.

Figure 4:
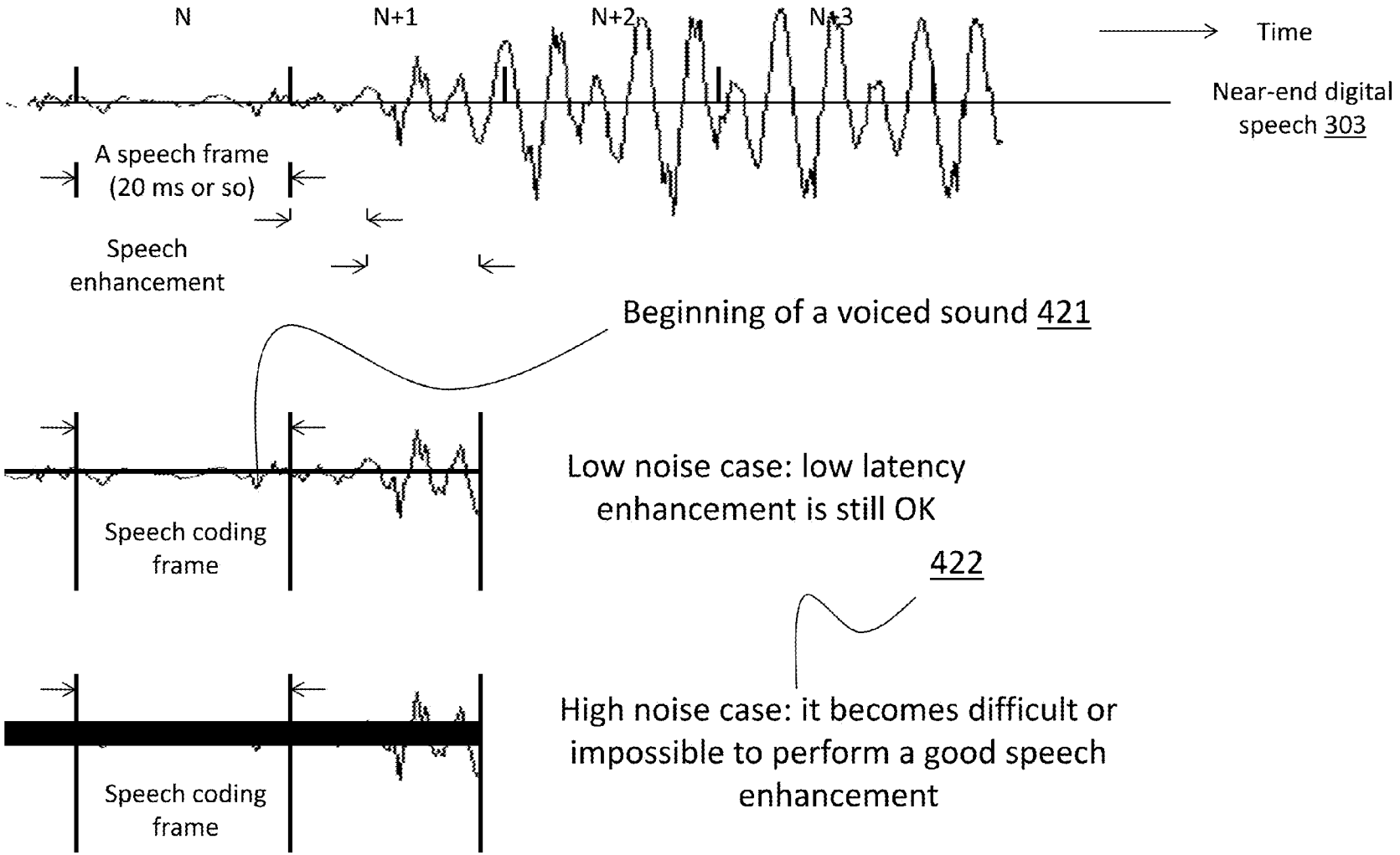
FIG. 4 shows an exemplary difficulty of a low latency speech enhancement technique.

FIG. 4 shows an exemplary difficulty of a low latency speech enhancement technique in the presence of high background noise levels. Considering an on-set portion of a voiced segment, when the noise level is low, it may still be possible that the on-set point 421 to be correctly identified. However, when the noise level is high 422, such detection becomes almost impossible, which results in detection errors. The detection of voiced vs. unvoiced speech in this particular example may also be difficult.

Figure 5:
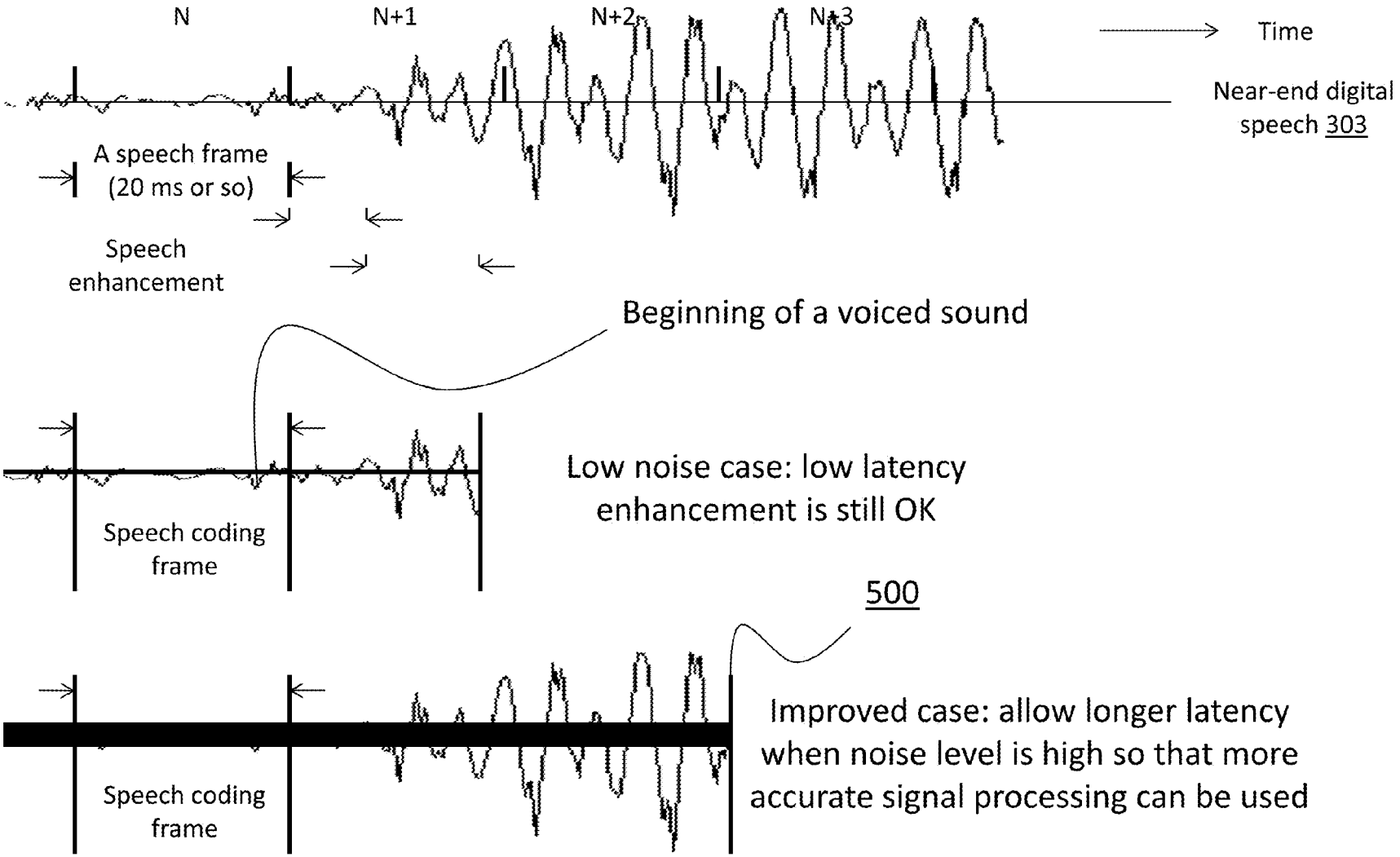
FIG. 5 demonstrates one of the benefits of an increased latency speech enhancement of the present invention.

Referring now to FIG. 5, when a larger latency budget is provided as shown in 500, it is significantly easier to identify the critical parameters. For example, it is now much easier to determine that the speech frame represents the onset portion of a voiced segment. Further, talker's pitch lag can also be more easily determined given more time or a larger latency budget.

Figure 6:
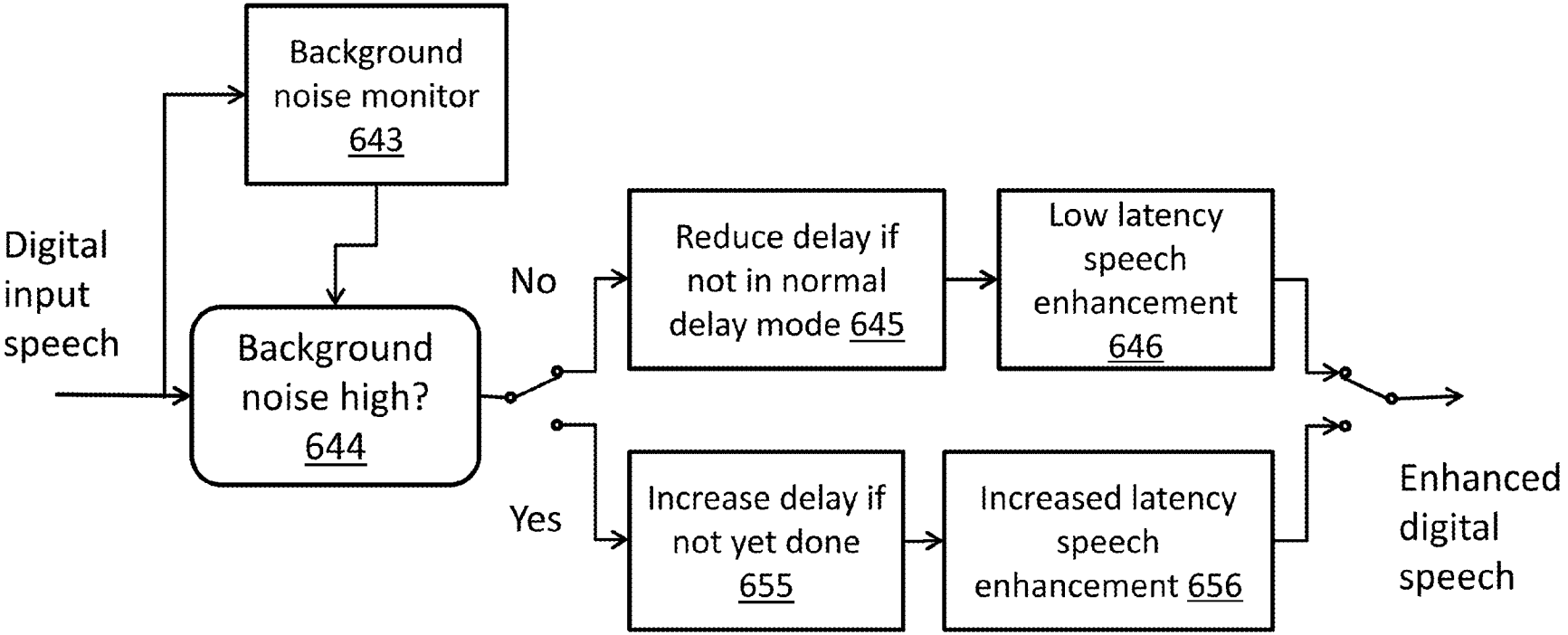
FIG. 6 presents an exemplary flowchart describing a method of applying an adaptive delay in accordance with one implementation of the present invention.

FIG. 6 illustrates an exemplary implementation of the present invention. A noise monitoring module 643 determines the background noise level of the digital speech input. As shown by 644, if the noise level is low, a low latency enhancement arrangement 646 is used. In this case, where the noise level is low, a normal low-latency speech enhancement technique is sufficient. As shown by module 645, the latency budget is adjusted accordingly. That is, the latency budget is reduced if it is currently operating in an increased latency mode, or the latency budget is unchanged if it is already operating in the low or normal latency mode. If on the other hand, the background noise level is high 644, an increased latency speech enhancement technique 656 is used and the latency budget is adjusted accordingly in step 655. That is, the latency budget or is increased if the operation is currently in the low or normal latency state, or the delay is unchanged, if it is currently operating in the high latency state.

In one embodiment of the present invention the increased latency speech enhancement techniques 656 are identical to the low-latency speech enhancement techniques 646. However, when a higher latency budget is allocated in accordance with the detected noise levels of the present invention, the increased latency speech enhancement technique 656 take advantage of the additional processing time using more available speech samples, which result in much better and/or more reliable parameter determinations. In other embodiments of the present invention, increased latency speech enhancement techniques 656 comprise altered, additional or entirely different signal processing techniques with more advanced and robust signal processing to take advantage of the additional speech samples available in high noise conditions. For example, in one embodiment of the present invention, the high-latency speech enhancer 656 comprises a modified version of the standard low-latency speech enhancer 646 so that it can take advantage of the information contained in additional speech packets.

In order to minimize unwanted audible impact to voice quality during a latency adjustment performed by the speech enhancers 645 and 655, the preferred method to perform such latency adjustments occurs during silence or unvoiced portions of speech. For example, silence or background noise periods may be indicated by a VAD/DTX (voice activity detection, discontinuous transmission) mode of the wireless system. This and other such means to determine silence or background noise periods are well known to those skilled in the relevant arts. This aspect of the present invention is shown with reference to FIGS. 7 and 8.

Figure 7:
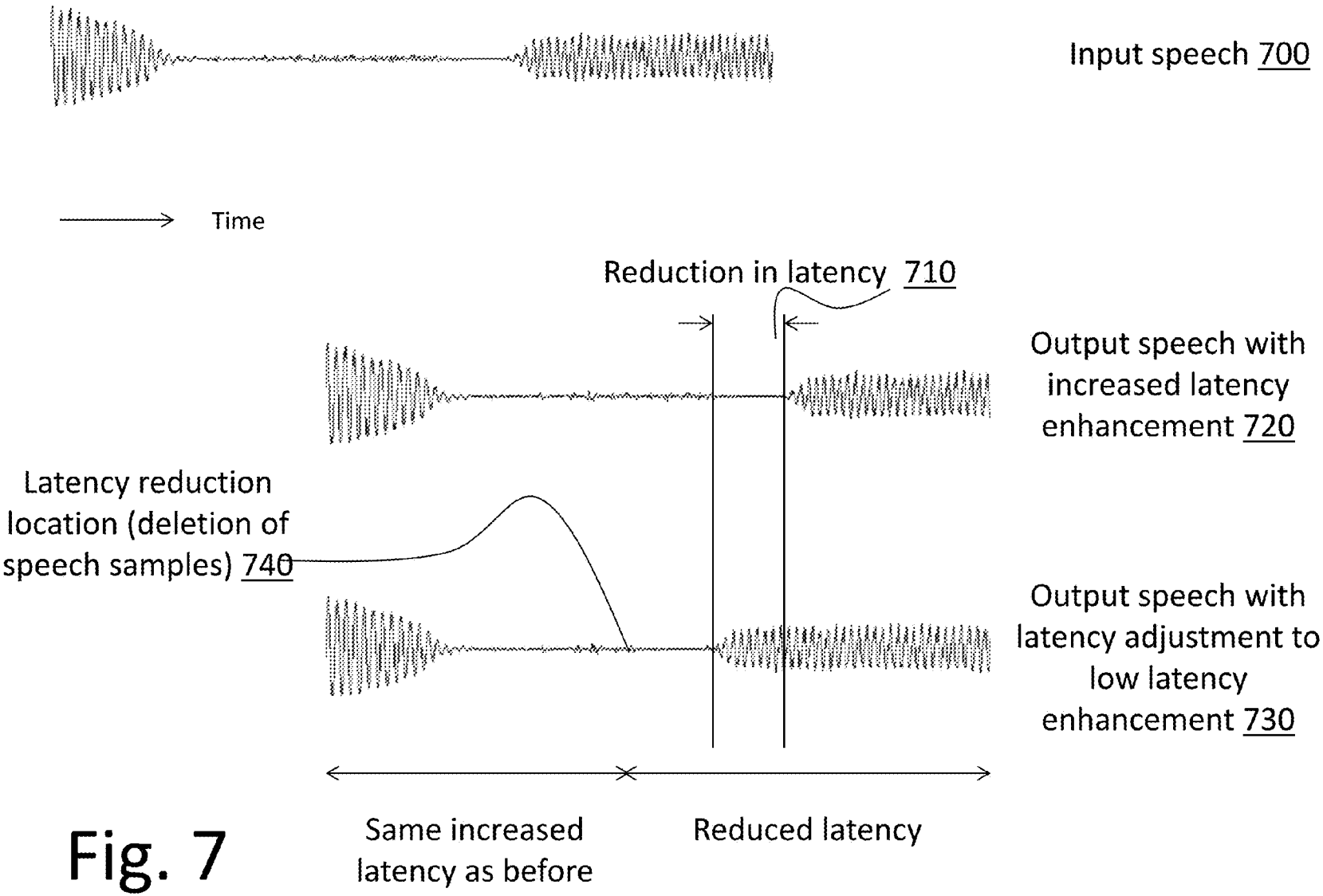
FIG. 7 shows a adjustment to decrease the latency during periods of unvoiced speech in accordance with an example embodiment of the present invention.

FIG. 7 illustrates the input speech signal 700. In this example, a latency adjustment is made to decrease the latency during periods of low background noise in accordance with the principles of the present invention. As stated, it is highly desirable to perform such latency adjustments during periods of silence or at least during unvoiced portions of speech. In this example, the latency reduction adjustment is performed at 710, during such an unvoiced timeframe. This results in an overall reduced latency that can be seen by comparing the before and after output speech signal diagrams 720 and 730. Further, the reduction or deletion of speech samples is illustrated in 740. This represents the difference between the number or speech samples that would have been processed by the high-latency speech enhancement techniques, versus the number of speech samples that are now being processed by the lower or reduced latency speech enhancement techniques.

Figure 8:
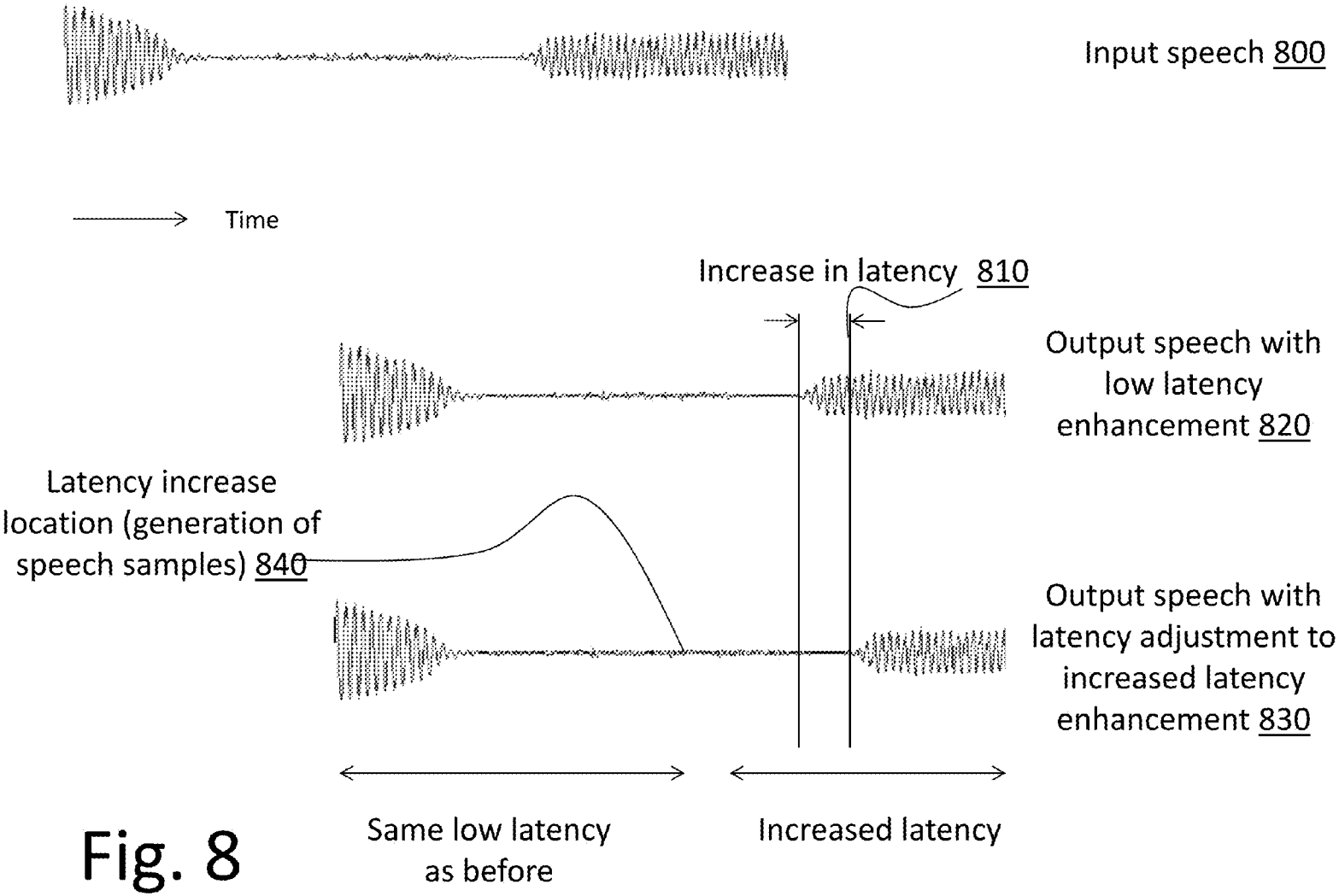
FIG. 8 shows an adjustment to increase the latency during periods of unvoiced speech in accordance with an example embodiment of the present invention.

FIG. 8 illustrates the input speech signal 800. In this example, a latency adjustment is made to increase the latency during periods of high background noise in accordance with the principles of the present invention. As stated, it is highly desirable to perform such latency adjustments during periods of silence or at least during unvoiced portions of speech. In this example, the latency reduction adjustment is performed at 810, during such an unvoiced timeframe. This results in an overall increased latency that can be seen by comparing the before and after output speech signal diagrams 820 and 830. Further, the addition or generation of speech samples is illustrated in 840. This represents the difference between the number or speech samples that would have been processed by the low-latency speech enhancement techniques, versus the number of speech samples that are now being processed by the higher latency speech enhancement techniques.

It is noted that, while such adjustments to the latency during silence or unvoiced portions of the speech can be straightforward, and such methods are well known by persons skilled in the art, the generation of silence and especially unvoiced speech samples should be performed in such a way to minimize the impact to speech quality.

Figure 9:
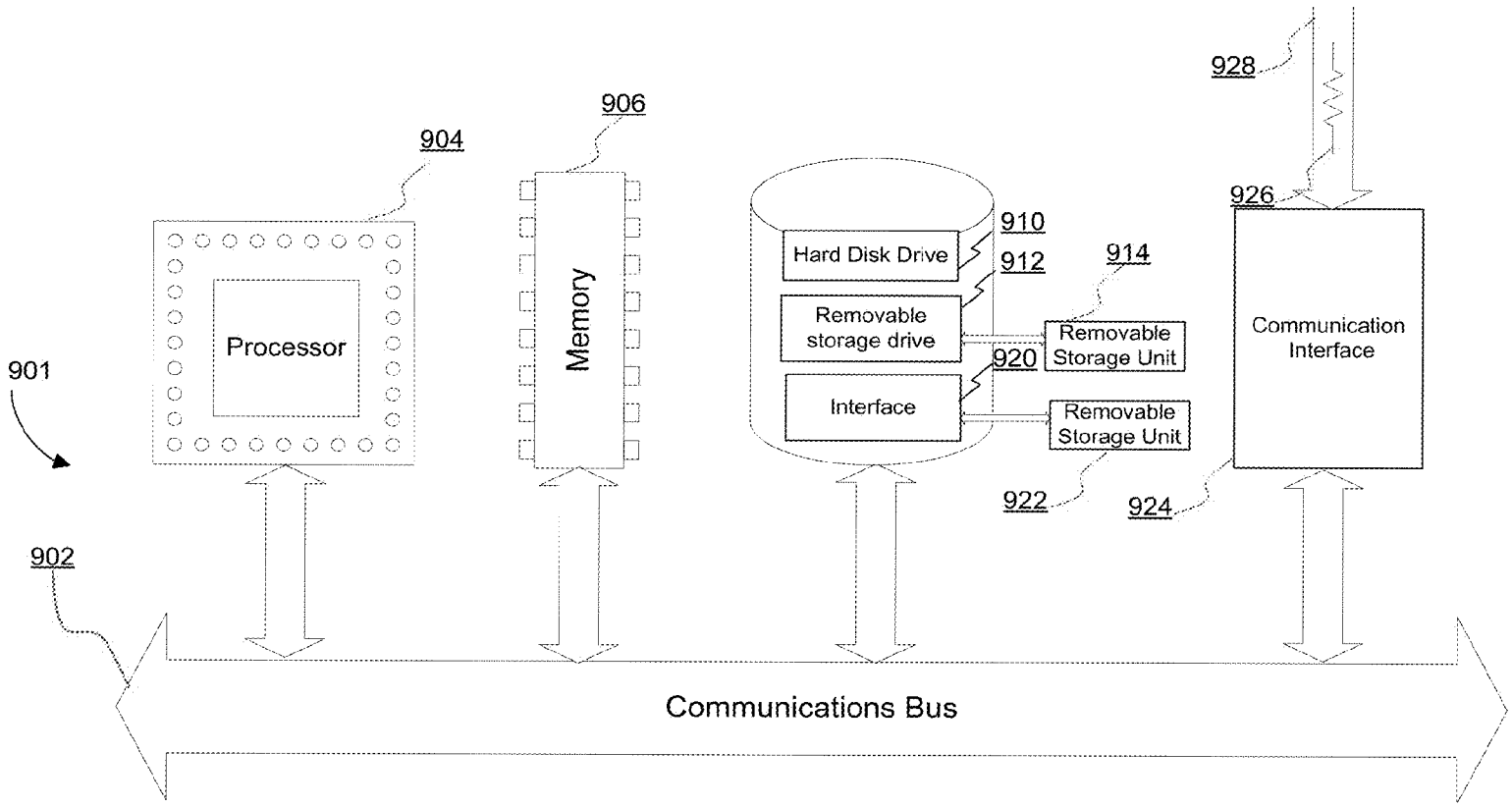
FIG. 9 illustrates a typical computer system capable of implementing an example embodiment of the present invention.

The present invention may be implemented using hardware, software or a combination thereof and may be implemented in a computer system or other processing system. Computers and other processing systems come in many forms, including wireless handsets, portable music players, infotainment devices, tablets, laptop computers, desktop computers and the like. In fact, in one embodiment, the invention is directed toward a computer system capable of carrying out the functionality described herein. An example computer system 901 is shown in FIG. 9. The computer system 901 includes one or more processors, such as processor 904. The processor 904 is connected to a communications bus 902. Various software embodiments are described in terms of this example computer system. After reading this description, it will become apparent to a person skilled in the relevant art how to implement the invention using other computer systems and/or computer architectures.

Computer system 901 also includes a main memory 906, preferably random access memory (RAM), and can also include a secondary memory 908. The secondary memory 908 can include, for example, a hard disk drive 910 and/or a removable storage drive 912, representing a magnetic disc or tape drive, an optical disk drive, etc. The removable storage drive 912 reads from and/or writes to a removable storage unit 914 in a well-known manner. Removable storage unit 914, represent magnetic or optical media, such as disks or tapes, etc., which is read by and written to by removable storage drive 912. As will be appreciated, the removable storage unit 914 includes a computer usable storage medium having stored therein computer software and/or data.

In alternative embodiments, secondary memory 908 may include other similar means for allowing computer programs or other instructions to be loaded into computer system 901. Such means can include, for example, a removable storage unit 922 and an interface 920. Examples of such can include a USB flash disc and interface, a program cartridge and cartridge interface (such as that found in video game devices), other types of removable memory chips and associated socket, such as SD memory and the like, and other removable storage units 922 and interfaces 920 which allow software and data to be transferred from the removable storage unit 922 to computer system 901.

Computer system 901 can also include a communications interface 924. Communications interface 924 allows software and data to be transferred between computer system 901 and external devices. Examples of communications interface 924 can include a modem, a network interface (such as an Ethernet card), a communications port, a PCMCIA slot and card, etc. Software and data transferred via communications interface 924 are in the form of signals which can be electronic, electromagnetic, optical or other signals capable of being received by communications interface 924. These signals 926 are provided to communications interface via a channel 928. This channel 928 carries signals 926 and can be implemented using wire or cable, fiber optics, a phone line, a cellular phone link, an RF link, such as WiFi or cellular, and other communications channels.

In this document, the terms "computer program medium" and "computer usable medium" are used to generally refer to media such as removable storage device 912, a hard disk installed in hard disk drive 910, and signals 926. These computer program products are means for providing software or code to computer system 901.

Computer programs (also called computer control logic or code) are stored in main memory and/or secondary memory 908. Computer programs can also be received via communications interface 924. Such computer programs, when executed, enable the computer system 901 to perform the features of the present invention as discussed herein. In particular, the computer programs, when executed, enable the processor 904 to perform the features of the present invention. Accordingly, such computer programs represent controllers of the computer system 901.

In an embodiment where the invention is implemented using software, the software may be stored in a computer program product and loaded into computer system 901 using removable storage drive 912, hard drive 910 or communications interface 924. The control logic (software), when executed by the processor 904, causes the processor 904 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method for improving the quality of a voice call transmitted over a communication link to a communication device, the communication device having a microphone for receiving a near-end voice signal and a near-end noise signal, the method comprising the steps of:

monitoring the near-end noise signal to determine an ambient noise level;

dynamically increasing the latency of the voice call to generate a high-latency voice call, when said ambient noise level is above a predetermined threshold; and dynamically decreasing the latency of the voice call to generate a low-latency voice call, when said ambient noise level is below said predetermined threshold.

2. The method of claim 1, further comprising the step of using a low-latency speech enhancer for enhancing the near-end voice signal during said low-latency voice call.

3. The method of claim 1, further comprising the step of using a high-latency speech enhancer for enhancing the near-end voice signal during said high-latency voice call.

4. The method of claim 1, wherein said step of dynamically increasing the latency further comprises the step of generating one or more speech samples.

5. The method of claim 4, wherein said step of generating additional speech samples is performed during periods of unvoiced speech.

6. The method of claim 1, wherein said step of dynamically decreasing the latency further comprises the step of deleting one or more speech samples.

7. The method of claim 6, wherein said step of deleting speech samples is performed during periods of unvoiced speech.

8. The method of claim 1, wherein said predetermined threshold in said step of said dynamically increasing the latency of the voice call, is different from said predetermined threshold in said step of dynamically decreasing the latency of the voice call.

9. A system for improving the quality of a voice call transmitted over a communication link to a communication device, the communication device having a microphone for receiving a near-end voice signal and a near-end noise signal, the method comprising the steps of:

a microphone capable of monitoring the near-end noise signal to determine an ambient noise level;

a latency adjustment module for dynamically increasing the latency of the voice call to generate a high-latency voice call, when said ambient noise level is above a predetermined threshold, and for decreasing the latency of the voice call to generate a low-latency voice call, when said ambient noise level is below said predetermined threshold.

10. The system of claim 9 further comprising a low-latency speech enhancer for enhancing the near-end voice signal during said low-latency voice call.

11. The system of claim 9 further comprising a high-latency speech enhancer for enhancing the near-end voice signal during said high-latency voice call.

12. The system of claim 9, wherein said latency adjustment module increases the latency of the voice call by generating one or more speech samples.

13. The system of claim 12, wherein said latency adjustment module generates one or more speech samples during periods of unvoiced speech.

14. The system of claim 9, wherein latency adjustment module decreases the latency of the voice call by deleting one or more speech samples.

15. The system of claim 14, wherein said latency adjustment module deletes one or more speech samples during periods of unvoiced speech.

16. The system of claim 9, wherein said predetermined threshold used for said dynamically increasing the latency of the voice call, is different from said predetermined threshold used for said decreasing the latency of the voice call.

17. A non-transitory computer program product comprising a computer useable medium having computer program logic stored therein, said computer program logic for improving the quality of a voice call transmitted over a communication wireless link to a communication device, the communication device having a microphone for receiving a near-end voice signal and a near-end noise signal, the method comprising the steps of:

code for monitoring the near-end noise signal to determine an ambient noise level;

code for dynamically increasing the latency of the voice call to generate a high-latency voice call, when said ambient noise level is above a predetermined threshold; and code for dynamically decreasing the latency of the voice call to generate a low-latency voice call, when said ambient noise level is below said predetermined threshold.

18. The non-transitory computer program product of claim 17, further comprising code for using a low-latency speech enhancer for enhancing the near-end voice signal during said low-latency voice call.

19. The non-transitory computer program product of claim 17, further comprising code for using a high-latency speech enhancer for enhancing the near-end voice signal during said high-latency voice call.

20. The non-transitory computer program product of claim 17, wherein said code for dynamically increasing the latency further comprises code for generating one or more speech samples.

21. The non-transitory computer program product of claim 20, wherein said code for generating additional speech samples is performed during periods of unvoiced speech.

22. The non-transitory computer program product of claim 17, wherein said step of dynamically decreasing the latency further comprises the step of deleting one or more speech samples.

23. The non-transitory computer program product of claim 22, wherein the step of deleting speech samples is performed during periods of unvoiced speech.

24. The non-transitory computer program product of claim 17, wherein said predetermined threshold in said code for dynamically increasing the latency of the voice call, is different from said predetermined threshold in said code for dynamically decreasing the latency of the voice call.

* * * * *